US006159047A

United States Patent [19]

Tanaka

[11] Patent Number: 6,159,047

[45] Date of Patent: Dec. 12, 2000

[54] ELECTRICAL CONNECTOR

[75] Inventor: Nobuyoshi Tanaka, Yokkaichi, Japan

[73] Assignee: Sumitomo Wiring Systems, Ltd., Japan

[21] Appl. No.: 09/307,213

[22] Filed: May 7, 1999

[30] Foreign Application Priority Data

May 8, 1998 [JP] Japan ..... 10-126328

[51] Int. Cl.[7] ..... H01R 13/40

[52] U.S. Cl. ..... 439/595; 439/752

[58] Field of Search ..... 439/595, 752, 439/752.5

[56] References Cited

U.S. PATENT DOCUMENTS

| | | | |
|---|---|---|---|
| 4,867,712 | 9/1989 | Kato et al. | 439/752 |
| 5,002,504 | 3/1991 | Carlson | 439/752.5 |
| 5,190,477 | 3/1993 | Akeda | 439/752.5 |
| 5,326,287 | 7/1994 | Hamakita et al. | 439/752 |
| 5,713,761 | 2/1998 | Okayasu | 439/595 |
| 5,928,034 | 7/1999 | Tabata et al. | 439/752.5 |

FOREIGN PATENT DOCUMENTS

| | | |
|---|---|---|
| 0 540 008 | 5/1993 | European Pat. Off. . |
| 0 790 670 | 8/1997 | European Pat. Off. . |
| 05047433 | 2/1993 | Japan . |
| 5-47433 | 2/1993 | Japan . |

*Primary Examiner*—T. C. Patel

*Attorney, Agent, or Firm*—Anthony J. Casella; Gerald E. Hespos; Michael J. Porco

[57] ABSTRACT

A connector is provided for production by a mold having a simple configuration. Inner surfaces of opposite side walls of a cavity (11) of the connector housing (10) are formed with guiding grooves (16) for permitting the passage of restricting projections (24) when a properly oriented female terminal fitting (20) is inserted. In the outer surfaces of the opposite side walls of the connector housing (10) are formed guide grooves (18) for permitting the passage of engaging projections (42) of a retainer (40). Through holes (17) are so formed in the side walls of the connector housing (10) as to provide partial communication between the guiding grooves (16) and the guide grooves (18).

7 Claims, 5 Drawing Sheets

ELECTRICAL CONNECTOR

BACKGROUND OF THE INVENTION

1. Field of the Invention

The present invention relates to a connector provided with a restricting projection for preventing the upside-down insertion of a terminal fitting.

2. Description of the Related Art

A known connector with a restricting projection for preventing upside-down insertion of a terminal fitting is disclosed in Japanese Unexamined Patent Publication No. 5-47433. This connector is constructed such that a restricting projection is formed on one side surface of a female terminal fitting, and a guiding groove for permitting the passage of this restricting projection is formed in the inner wall of a cavity of a connector housing. When the terminal fitting is properly oriented, the restricting projection can pass along the guide groove and the terminal can be inserted into the cavity. When the terminal fitting is upside-down, the restricting projection is unable to enter the guiding groove, and hence the terminal fitting cannot be inserted into the cavity.

This type of prior art connector generally is provided with a resin locking portion for locking the terminal fitting into the cavity and a retainer for preventing the deformation of the resin locking portion in an unlocking direction. The retainer is mountable on the connector housing by engaging an elastic engaging claw integrally formed therewith with an engaging hole formed in the connector housing.

However, in the aforementioned connector, the guide groove in the connector housing and the engaging hole used to mount the retainer must be formed independently. This complicates the construction of a mold, especially of a pin portion for forming the cavity, thereby increasing the cost for the mold. Furthermore, the pin is less rigid and more likely to break.

In view of the above problems, an object of the present invention is to provide a connector which can be produced by a mold having a simplified construction.

SUMMARY OF THE INVENTION

According to the invention, there is provided a connector in which at least one terminal fitting is inserted or insertable into a cavity formed in a connector housing. A retainer is at least partially mounted on the connector housing for retaining the terminal fitting substantially in the cavity. The terminal fitting is provided with at least one restricting projection for preventing the terminal fitting from being inserted upside-down or in a wrong orientation. Additionally, an inner wall surface of the cavity of the connector housing is formed with at least one guiding groove or a corresponding number of guide grooves for permitting the passage of the restricting projection(s) when the terminal fitting is inserted while being properly oriented. At least one through hole penetrates an outer wall of the connector housing, and is substantially continuous with the guiding groove. Thus the retainer is made mountable on the connector housing by engaging at least one engaging projection formed in or on the retainer with the through hole. Accordingly, since the through hole used to mount the retainer can be formed, taking advantage of the guiding groove for preventing the upside-down insertion of the terminal fitting, a mold has a simple construction. The through hole may be substantially continuous with the back or rear portion of the guiding groove as seen in an insertion direction of the terminal fitting.

According to a preferred embodiment, there is provided a connector in which a terminal fitting is inserted into a cavity formed in a connector housing. A resin or elastic locking portion formed in the connector housing locks the terminal fitting to prevent the terminal fitting from coming out of the cavity. A retainer for restricting a deformation of the resin or elastic locking portion in an unlocking direction is mounted on the connector housing. The terminal fitting is provided with a restricting projection for preventing the terminal fitting from being inserted upside-down, and an inner wall surface of the cavity of the connector housing is formed with a guiding groove for permitting the passage of the restricting projection when the terminal fitting is inserted while being properly oriented.

A through hole penetrates an outer wall of the connector housing and is continuous with the back of the guiding groove. The retainer is made mountable on the connector housing by engaging an engaging projection formed in the retainer with the through hole.

Preferably, a guide groove for guiding the engaging projection of the retainer toward the through hole is formed in the outer wall of the connector housing, and the through hole communicates with the rear end of the guide groove and the rear end of the guiding groove. Accordingly, the through hole can be formed, taking advantage of a mold pin for forming the guide groove and the guiding groove. This obviates the need for a slide construction, enabling the mold to be further simplified.

At least one resin or elastic locking portion formed in the connector housing locks or can lock the terminal fitting to prevent the terminal fitting from coming out of the cavity. Thus the terminal fitting can be securely locked in the cavity.

The connector housing may be formed with a deformation permitting space for permitting the elastic locking portion to be deflected or deformed upon insertion and withdrawal of the terminal fitting into or from the cavity.

Further, the retainer may comprise at least one deformation restricting portion for restricting a deformation of the resin or elastic locking portion in an unlocking direction thus retaining the terminal fitting substantially in the cavity. Thus the retainer securely prevents the terminal fitting from coming out of the cavity. The deformation restricting portion preferably is located in the deformation permitting space when the retainer is at least partially mounted on the connector housing. According to a further preferred embodiment, the at least one restricting projection is formed on a substantially box-shaped portion of the terminal fitting. These and other objects, features and advantages of the present invention will become more apparent upon a reading of the following detailed description and accompanying drawings.

DETAILED DESCRIPTION OF THE PREFERRED EMBODIMENTS

Figure 1:
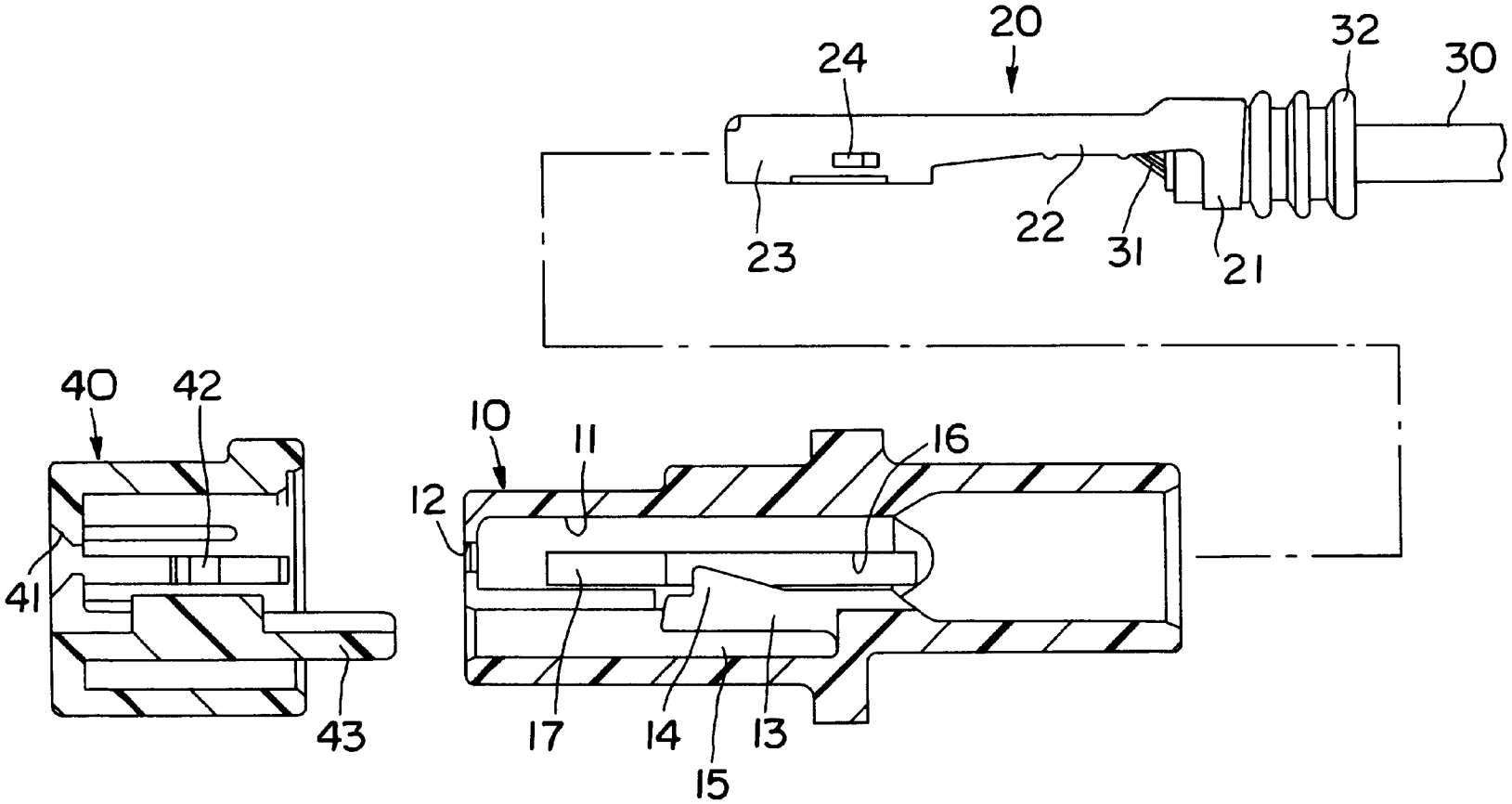
FIG. 1 is an exploded vertical section of a connector according to a first embodiment of the invention.
Figure 2:
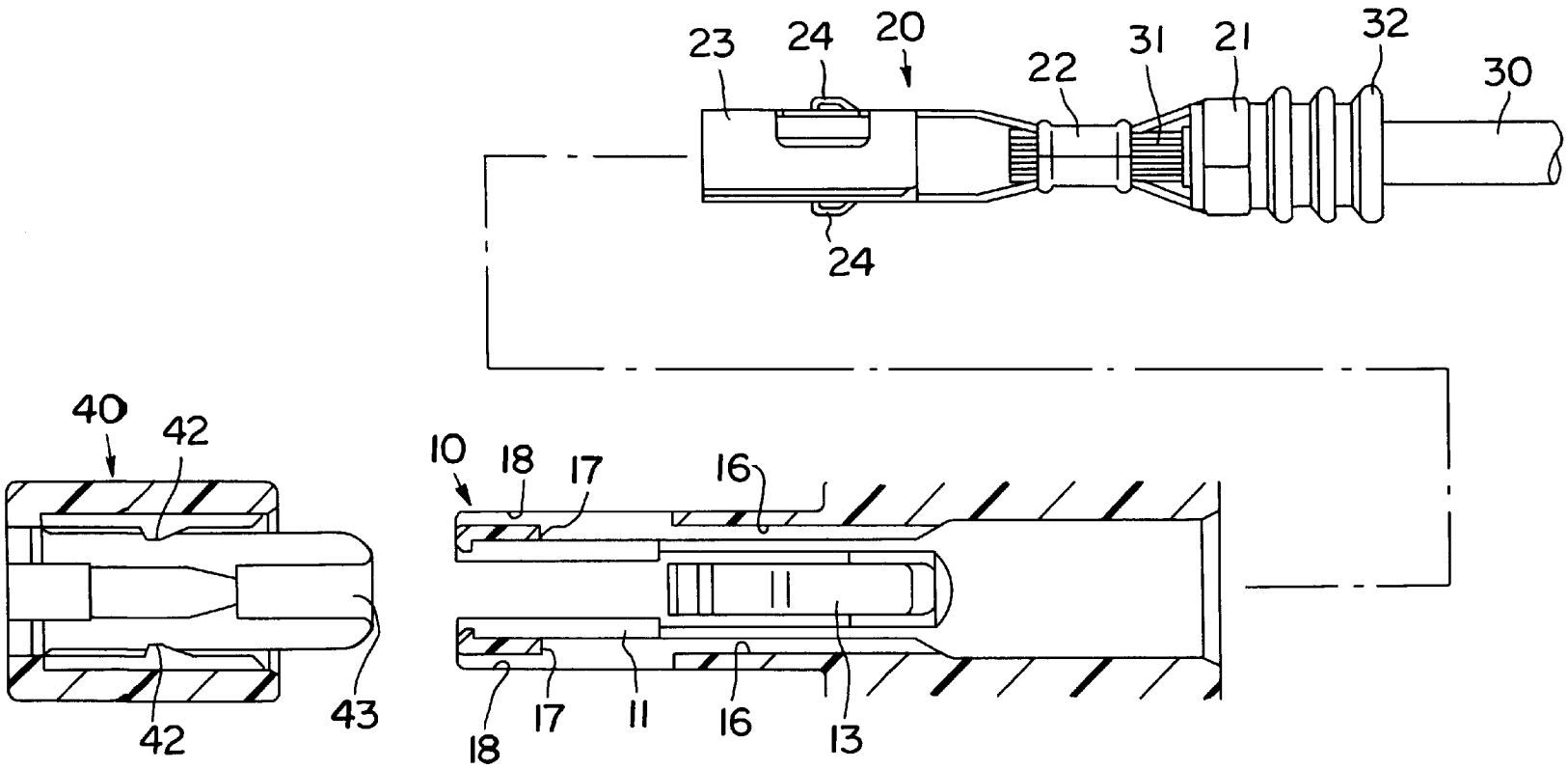
FIG. 2 is an exploded horizontal section of the connector.
Figure 3:
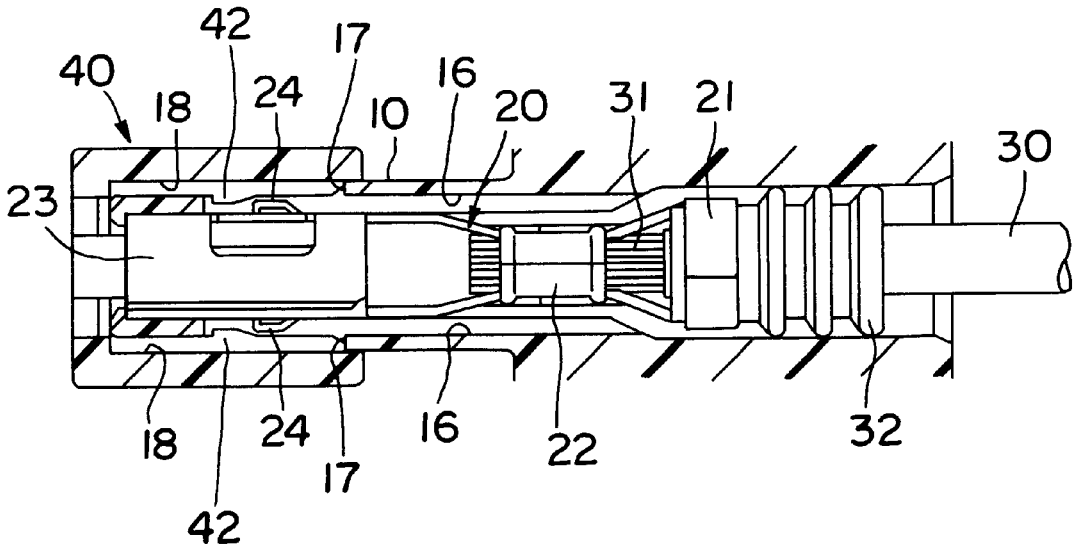
FIG. 3 is a horizontal section of the assembled connector.

A connector housing in accordance with the invention is identified by the numeral 10 in FIGS. 1–3. The connector housing 10 is formed with a cavity 11 for substantially accommodating a female terminal fitting 20. The cavity 11 substantially extends along forward and backward directions (transverse direction of FIG. 1). A tab insertion opening 12 communicates with the cavity 11 and is open in the mating or front surface of the connector housing 10. A tab portion of an unillustrated male terminal fitting is inserted or insertable through the tab insertion opening 12 for connection with the female terminal fitting 20 accommodated in the cavity 11.

An elastic or resin locking portion 13 (or deformable or deflectable locking portion) is integrally or unitarily formed in the cavity of the connector housing 10. The elastic locking portion 13 is so formed that its free end projects forward of the connector housing 10 and has a locking projection 14 on the upper surface of its leading end. A deformation permitting space 15 is formed below or in a deflection direction of the elastic locking portion 13 for permitting the leading end of the elastic locking portion 13 to be deformed downwardly.

The female terminal fitting 20 is of a known shape, and is comprised of an insulation barrel 21 to be fastened to an insulation coating of the wire 30 together with a rubber seal 32 for protecting the wire 30 from water. A wire barrel 22 is fastened to a core 31 of the wire 30 and a substantially box-shaped portion 23 is formed before or adjacent or neighboring the barrels 21, 22. An elastic contact piece (not shown) to be connected with the unillustrated male terminal fitting is provided in the box-shaped portion 23.

Restricting projections 24 are formed on the outer surfaces of the preferably opposite side walls of the box-shaped portion 23. The restricting projections 24 are substantially continuous with sections of the box-shaped portion 23 before and after the restricting projections 24 along the insertion direction of the female terminal fitting 20. However, the restricting projections 24 are cut off from sections of the box-shaped portion 23 at the top and bottom and bulge out preferably in U-shape therefrom, as shown in FIG. 2. The restricting projections 24 are formed in positions displaced from the vertical center of the female terminal fitting 20, so that the positions thereof along vertical direction are different if the female terminal 20 is held upside-down.

Guiding grooves 16 are formed in the inner surface of the opposite side walls of the cavity 11 of the connector housing 10 and extend substantially along the insertion direction of the female terminal fitting 20. The guiding grooves 16 permit the passage of the restricting projections 24 only when the female terminal fitting 20 is oriented properly. Through holes 17 are formed at the back of the guiding grooves 16 and substantially penetrate the side walls of the connector housing 10. The through holes 17 are formed to communicate preferably with the halves of corresponding guide grooves 18 which extend backwardly from the leading end of the cavity 11 to an intermediate position, and the front parts of the guiding grooves 16 of the restricting projections 24 (see FIG. 2). The through holes 17 are formed by providing projections for forming the guide grooves 18 in a specified portion of a mold for forming the outer wall of the connector housing 10 and projections for forming the guiding grooves 16 in a specified portion of the mold for forming the cavity 11, such that the leading ends of these projections are to be brought into contact to overlap when the molds are clamped.

A retainer 40 is mountable on a front part of the connector housing 10. The retainer 40 has a substantially rectangular tubular shape and substantially covers the front part of the connector housing 10 in its mount position. A tab insertion opening 41 is formed in a position of the retainer 40 substantially corresponding to the tab insertion opening 12 of the connector housing 10. The tab insertion opening 41 permits the insertion of the tab portion of the male terminal fitting. Engaging projections 42 are formed on the inner surfaces of the opposite side walls of the retainer 40. The engaging projections 42 are engageable with the through holes 17 by being inserted along the guide grooves 18 of the connector housing 10.

The retainer 40 is formed with a deformation restricting portion 43 which is located in the deformation permitting space 15 or in a deflection direction of or preferably below the elastic locking portion 13 of the connector housing 10 when the retainer 40 is mounted properly. The deformation restricting portion 43 is located below the elastic locking portion 13 when the connector housing 10, the female terminal fitting 20 and the retainer 40 are properly assembled with each other, thereby restricting the deformation of the elastic locking portion 13.

This embodiment is constructed as described above, and is assembled in the following procedure.

When a properly oriented female terminal fitting 20 is inserted into the cavity 11, preferably from behind the connector housing 10, the leading end of the boxshaped portion 23 is brought or bringable into contact with the locking projection 14 of the elastic locking portion 13. The elastic locking portion 13 then is deformed toward the deformation permitting space 15, and the female terminal fitting 20 has been inserted or insertable in an insertion direction or toward the back of the cavity 11. At this time, the guiding grooves 16 of the connector housing 10 permit the passage of the restricting projections 24 formed on the box-shaped portion 23. When the female terminal fitting 20 is inserted substantially to its proper position, the elastic locking portion 13 returns to its original position due to its elastic restoring force, and is engaged with the bottom rear end of the box-shaped portion 23, with the result that the female terminal fitting 20 is locked in the cavity 11.

If the female terminal fitting 20 is inserted upside-down into the cavity 11, an operator can notice an error since the restricting projections 24 cannot enter the guiding grooves 16.

On the other hand, when the retainer 40 is mounted on the front part of the connector housing 10, the engaging projections 42 of the retainer 40 are slightly elastically deformed outwardly to pass along the guide grooves 18 of the connector housing 10. When the retainer 40 substantially reaches its proper mount position, the engaging projections 42 fall into the through holes 17 due to their elastic restoring forces to prevent the disengagement of the retainer 40 from the connector housing 10. In this way, the assembling is completed (see FIG. 3).

This embodiment has an advantage that the mold has a simple configuration since the locking mechanism for the retainer 40, i.e. the through holes 17 can be formed, taking advantage of the guiding grooves 16 that are formed to prevent the female terminal fitting 20 from being inserted upside-down according to this embodiment.

Figure 4:
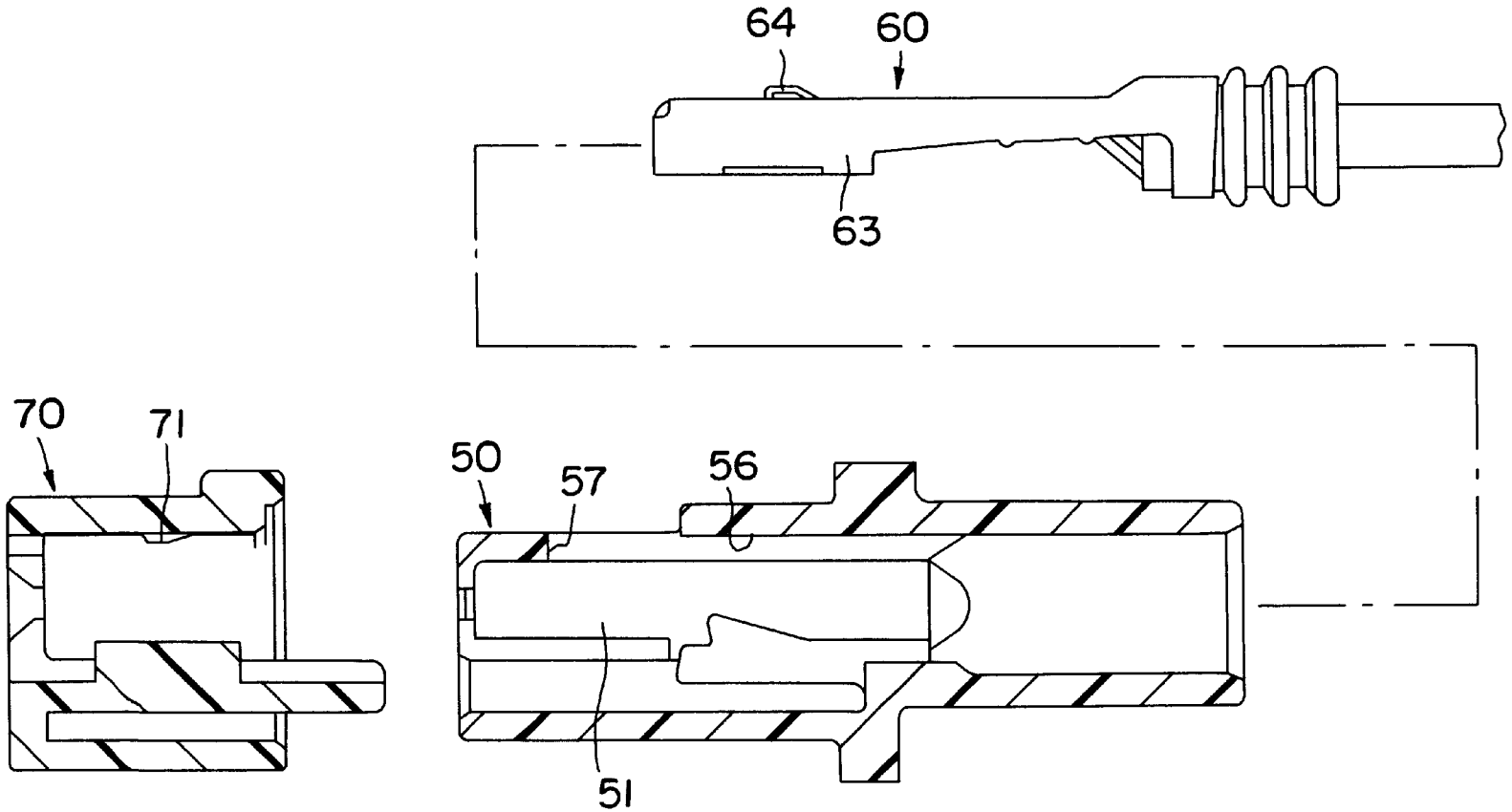
FIG. 4 is an exploded vertical section of a connector according to a second embodiment of the invention.
Figure 5:
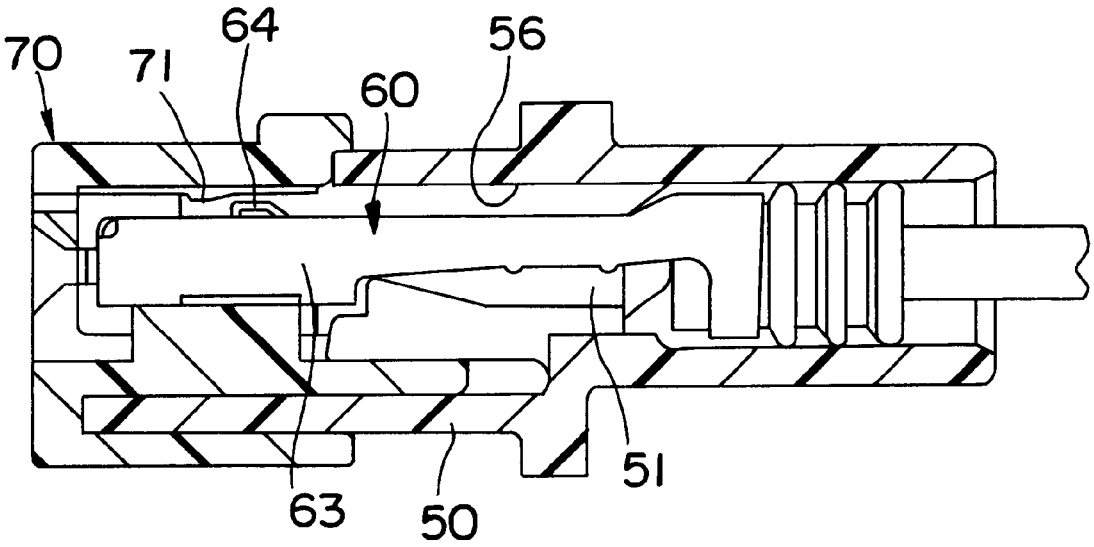
FIG. 5 is a vertical section of the assembled connector of FIG. 4.

FIGS. 4 and 5 show a second embodiment. Unlike the restricting projections 24 of the female terminal fitting 20 in the first embodiment, a restricting projection is formed on the outer surface of the upper wall of the box-shaped portion 63. In the following, no description is given on the same or similar elements as those of the first embodiment.

A restricting projection 64 formed on the outer surface of the upper wall of a substantially box-shaped portion 63 of a female terminal fitting 60 as shown in FIG. 4 is substantially continuous with the box-shaped portion 63 adjacent or at its front and rear ends with respect to the insertion direction of the female terminal fitting 60, and bulges out, preferably in U-shape, by being cut off at its left and right sides.

On the other hand, a guiding groove 56 for permitting the passage of the restricting projection 64 when the female terminal fitting 60 is inserted while being properly oriented is formed in the inner surface of the ceiling wall of a cavity 51 of a connector housing 50. Further, a through hole 57 is formed at one end or at the back of the guide groove 56.

A retainer 70 preferably having a substantially rectangular tubular shape is mountable on a front part of the connector housing 50. An engaging projection 71 engageable with the through hole 57 of the connector housing 50 is formed on the inner surface of the ceiling wall of the retainer 70.

During the assembling of the connector according to this embodiment, the restricting projection 64 formed on the box-shaped portion 63 is permitted to enter the cavity 51 by the guiding groove 56 of the connector housing 50. Thus, if the female terminal fitting 60 is mistakenly inserted upside-down into the cavity 51, the female terminal fitting 60 cannot be inserted to its proper mount position because of the restricting projection 64 standing in the way. Further, when the retainer 70 is mounted on the front part of the connector housing 50, the engaging projection 71 of the retainer 70 moves while being slightly elastically deformed upward. When the retainer 70 reaches its proper mount position, the engaging projection 71 falls into the through hole 57 due to its elastic restoring force (see FIG. 5).

In this embodiment as well, the mold having a simple configuration can be used since the locking mechanism for the retainer 70, i.e. the through holes 57 can be formed, taking advantage of the guiding groove 56 that is formed to prevent the female terminal fitting 60 from being inserted upside-down.

The present invention is not limited to the described and illustrated embodiment, but a variety of changes can be made without departing from the scope and spirit of the invention as defined in the claims.

What is claimed is:

1. A connector comprising:

a connector housing having opposed front and rear ends, at least one outer surface extending between the ends and at least one cavity formed in the connector housing, the cavity defining at least one inner surface extending between the ends;

at least one terminal fitting inserted into the cavity from the rear end of the connector housing along an insertion direction, at least one restricting projection projecting outwardiy on the terminal fitting for preventing the terminal fitting from being inserted into the cavity upside-down;

a retainer mounted on the front end of the connector housing for retaining the terminal fitting in the cavity, a portion of the retainer surrounding the front end of the connector housing and having at least one inwardly projecting engaging projection;

at least one guiding groove formed on the inner surface of the cavity and extending forwardly along the insertion direction from the rear end of the connector housing, the guiding groove for permitting passage of the at least one restricting projection when the terminal fitting is properly oriented; and at least one guide groove formed in the outer surface of the connector housing and extending rearwardly from the front end of the connector housing, the guide groove on the outer surface of the connector housing being substantially aligned with and partly overlying the guiding groove on the inner surface, the guiding groove and the guide groove being sufficiently deep to define a through hole where the guide groove and the guiding groove overlie, wherein the retainer is mountable on the connector housing by engaging the engaging projection of the retainer with the through hole.

2. A connector according to claim 1, wherein at least one elastic locking portion is formed in the cavity for locking the terminal fitting to prevent the terminal fitting from coming out of the cavity.

3. A connector according to claim 2 wherein the cavity is formed with a deformation permitting space disposed such that the elastic locking portion can deflect upon insertion and withdrawal of the terminal fitting into and from the cavity.

4. A connector according to claim 3, wherein the retainer comprises at least one deformation restricting portion for restricting a deformation of the elastic locking portion in an unlocking direction thus retaining the terminal fitting substantially in the cavity.

5. A connector according to claim 6, wherein the deformation restricting portion is located in the deformation permitting space when the retainer is at least partially mounted on the connector housing.

6. A connector according to claim 1, wherein the at least one restricting projection is formed on a substantially box-shaped portion of the terminal fitting.

7. A connector according to claim 1, having at least two of said cavities into which a corresponding number of terminal fittings are insertable, each of said cavities being provided with at least one of said guiding grooves the outer surface of the connector housing having a plurality of said guide grooves, each said guide groove in the outer surface, being aligned with and partly overlapping one of said guiding grooves, such that each said guide groove has a corresponding one of said through holes.

* * * * *